US007607555B2

(12) United States Patent
Smith

(10) Patent No.: US 7,607,555 B2
(45) Date of Patent: Oct. 27, 2009

(54) PUNCTURABLE CAP AND PIERCER

(75) Inventor: Mark A. Smith, Plainfield, IL (US)

(73) Assignee: DS Smith Plastics Limited (GB)

( * ) Notice: Subject to any disclaimer, the term of this patent is extended or adjusted under 35 U.S.C. 154(b) by 118 days.

(21) Appl. No.: 11/365,097

(22) Filed: Mar. 1, 2006

(65) Prior Publication Data

US 2007/0205216 A1 Sep. 6, 2007

(51) Int. Cl.
*B67D 5/00* (2006.01)

(52) U.S. Cl. ..... 222/81; 220/267; 215/257

(58) Field of Classification Search ..... 222/80–90, 222/5, 541.2, 153.01; 215/297, 257; 220/267, 220/251, 252, 521, 522, 260, 277, 278
See application file for complete search history.

(56) References Cited

U.S. PATENT DOCUMENTS 4,325,496 A * 4/1982 Malpas ..... 222/83
4,519,184 A 5/1985 Brunswick
4,530,202 A 7/1985 Powell et al.
4,598,529 A 7/1986 Pongrass et al.
RE32,354 E 2/1987 Savage
4,666,064 A 5/1987 Hoehn
4,699,188 A 10/1987 Baker et al.
4,765,511 A * 8/1988 Clements ..... 222/83
4,821,488 A 4/1989 Donald
4,942,716 A 7/1990 Anderson
5,048,723 A 9/1991 Seymour
5,071,035 A 12/1991 Kiplinger
5,095,962 A 3/1992 Lloyd-Davies et al.
5,111,970 A * 5/1992 Rutter et al. ..... 222/83
5,131,566 A 7/1992 Bavegems
5,141,133 A 8/1992 Ninomiya et al.
5,141,134 A * 8/1992 Machado ..... 222/83.5
5,265,766 A 11/1993 Kurtzahn et al.
5,325,995 A 7/1994 Harrison et al.
5,334,180 A 8/1994 Adolf et al.
5,379,918 A 1/1995 Goto
5,392,958 A 2/1995 Kurtzahn et al.
5,425,528 A 6/1995 Rains et al.
5,467,806 A 11/1995 Stricklin et al.
5,482,176 A 1/1996 Maietta et al.
5,514,123 A 5/1996 Adolf et al.
5,609,195 A * 3/1997 Stricklin et al. ..... 141/346
5,775,541 A 7/1998 Perkins
5,782,345 A * 7/1998 Guasch et al. ..... 206/222
5,855,298 A 1/1999 Teetsel, III et al.
5,884,810 A 3/1999 Vizcarra et al.

(Continued)

*Primary Examiner*—Lien T Ngo
(74) *Attorney, Agent, or Firm*—Rockey, Depke & Lyons, LLC; Kathleen A. Lyons; Joseph A. Fuchs

(57) ABSTRACT

The present invention is directed to a fitment assembly for a container. The fitment assembly includes a spout connected in fluid communication to the container, a cap sealing an end of the spout, the cap having a pierceable center, and a piercer for puncturing the cap at the pierceable center to permit fluid communication from the container through the spout and piercer. The present invention provides a seal between an annular skirt of the piercer and a circumferential wall of the cap so that when the piercer punctures the cap a seal is formed. The present invention also provides an additional means of securing the piercer to the cap utilizing the circumferential wall of the cap and the annular skirt of the piercer.

10 Claims, 3 Drawing Sheets

U.S. PATENT DOCUMENTS 5,921,419 A 7/1999 Niedospial, Jr. et al.
6,039,301 A 3/2000 Westerhof
6,098,844 A 8/2000 Nicolle
6,098,845 A 8/2000 Stern
6,116,445 A * 9/2000 Ikemori et al. ..... 215/301
6,126,045 A 10/2000 Last
6,142,341 A 11/2000 Uematsu
6,155,465 A 12/2000 Steiger
6,257,453 B1 7/2001 Graham
6,270,867 B1 8/2001 Eckstein et al.
6,305,575 B1 10/2001 Wrigley
6,321,941 B1 11/2001 Argentieri et al.
6,378,730 B1 4/2002 Reddy et al.
6,398,075 B1 6/2002 Laciacera et al.
6,477,743 B1 11/2002 Gross et al.
6,705,462 B2 * 3/2004 Kasuya ..... 206/222
6,971,548 B2 12/2005 Smith
7,357,277 B2 * 4/2008 Verespej et al. ..... 222/153.01
7,387,220 B2 * 6/2008 Verespej et al. ..... 222/153.01
2007/0267435 A1 * 11/2007 Yamada et al. ..... 222/80

* cited by examiner

PUNCTURABLE CAP AND PIERCER

BACKGROUND OF THE INVENTION

This invention relates to flexible containers, and more particularly to a fitment assembly for such containers. Flexible polymeric containers are well known for storing and dispensing wine, dairy products, enteral feeding solutions, fruit juices, tea and coffee concentrates, puddings, cheese sauces, and many other flowable materials, including those that must be filled aseptically. These generally include low acid materials. Flexible polymeric containers typically have walls made of polymeric films with either a monolayer or multiple layer structure. The particular polymers constituting the container film layers vary depending on the type of material to be placed in the container. The film layers may also include an oxygen barrier material layer to prevent contact between such materials and oxygen or other gas sensitive contents. The walls of the containers may be metallized, or coated with a metallic layer such as aluminum to prevent incursion of oxygen or other gases. A separate metallized enclosure may also encase the polymeric container.

The flexible polymeric containers have inlets and/or spouts for filling and dispensing the container contents. The containers are also often placed within a box. The spout extends through an opening in the box to dispense the contents. Such packaging systems are commonly referred to as "bag-in-box." Bag-in-box packaging systems are often used in restaurants and convenience stores to facilitate service of liquid food products such as syrups, toppings, and condiments.

After the container is filled with a desired material, the spout is capped to seal the container and protect the contents from contamination. Depending on the type of contents, the container, spout, cap, and contents may be heat sterilized using steam, an autoclave process, or similar method.

To access and dispense the contents of the container, the cap must be removed from the spout. Often, cap removal requires a tool to remove the cap because the sterilization process may cause the cap to be rigidly affixed to the spout. This presents a problem for end users. Tools are often misplaced or unavailable, making removal of the cap difficult. Moreover, a great deal of force is needed to remove the cap from the spout, causing potential spillage of the container contents.

For these reasons, a fitment for use with a flexible container which can be easily assembled and installed into a dispensing system, and that minimizes effort in accessing the container's contents while also minimizing contamination of the contents is desired.

SUMMARY OF THE INVENTION

The present invention provides a fitment assembly for a container including a spout connected in fluid communication to the container, a cap sealing an end of the spout, the cap having a pierceable center, and a piercer for puncturing the cap at the pierceable center to permit fluid communication from the container through the spout and piercer.

The present invention also provides a seal between an annular skirt of the piercer and a circumferential wall of the cap so that when the piercer punctures the cap a seal is formed. In one embodiment of the present invention, the annular skirt of the piercer includes at least one sealing bead. When the piercer punctures the cap, the sealing bead presses against the circumferential wall of the cap and forms a seal. While prior art fitment assemblies include a cap and a piercer, none of the prior art fitment assemblies provided a seal between the annular skirt of the piercer and the circumferential wall of the cap.

It should be appreciated that other embodiments of the present invention can include the sealing bead being part of the cap instead of the piercer.

Prior art assemblies have generally utilized the piercing piece to secure the piercer to the cap. The present invention provides an additional means of securing the piercer to the cap when the piercer punctures the cap by also using the circumferential wall of the cap and the annular skirt of the piercer. A sealing bead and a corresponding indent or slot can be mated together when the piercer pierces the cap, securing the annular skirt of the piercer and the circumferential wall of the cap. This securing of the annular skirt and the circumferential wall can also serve as a seal.

In another aspect, the present invention provides a method of dispensing fluid from a container, including the steps of providing a spout connected in fluid communication to the container, sealing an end of the spout with a cap, the cap having a pierceable center, and piercing the cap at the pierceable center to permit fluid communication from the container through the spout. Additionally, the present invention provides a seal between the circumferential wall of the cap and the annular skirt of the piercer to prevent spillage while accessing the fluid in the container.

The present invention provides a fitment assembly and dispensing method that permits easy assembly, installation, and dispensing while minimizing opportunity for contamination of the container contents. Additional features and advantages of the present invention are described in, and will be apparent from, the following Detailed Description of the Invention and the Figures.

DETAILED DESCRIPTION

Figure 1:
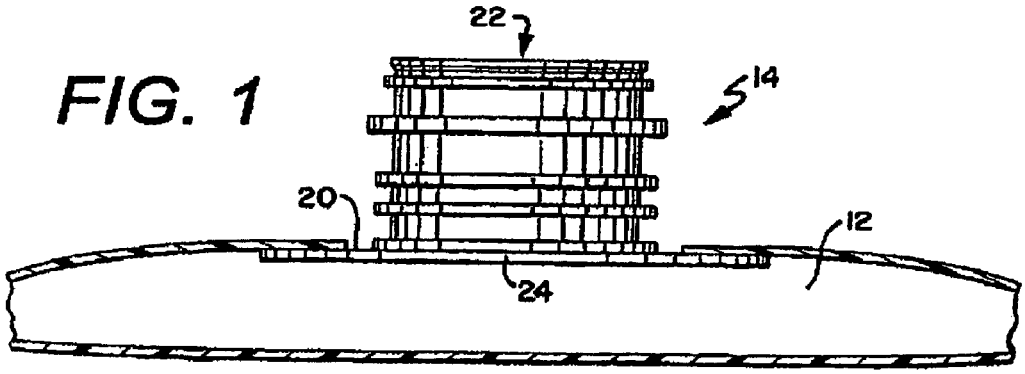
FIG. 1 is a schematic view of a spout and a container of the present invention.

While this invention is susceptible of embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

Figure 2:
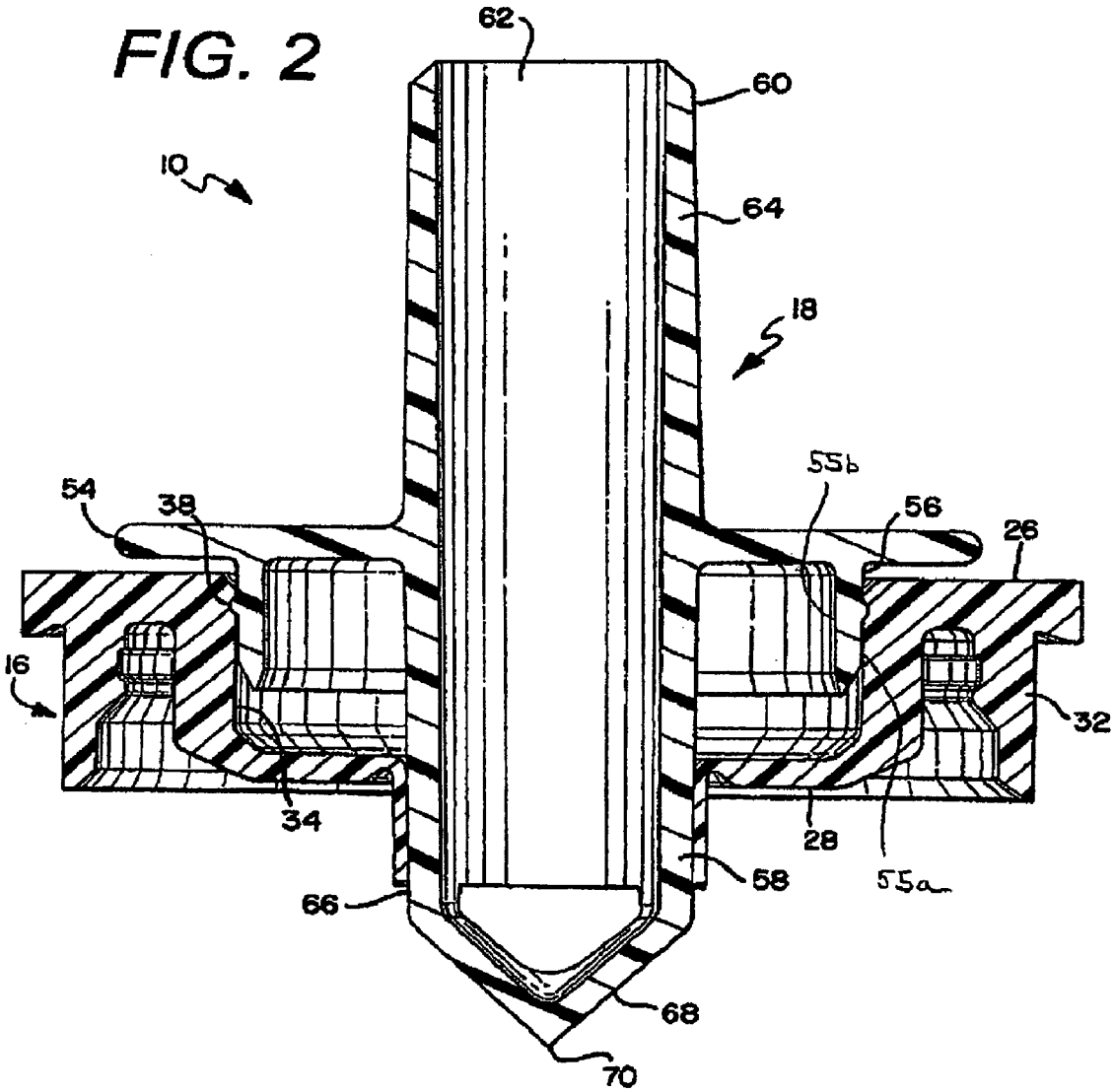
FIG. 2 is a cross-sectional view of a fitment assembly of the present invention.

FIGS. 1 and 2 show a fitment assembly 10 of the present invention. The fitment assembly 10 includes a container 12, a spout 14, a cap 16, and a piercer 18. The cap 16 is placed over the spout 14 to seal off an end of the spout 14. The container 12 has an opening 20. The spout 14 has a passageway 22 and a base 24. The base 24 is located at the end of the spout opposite from the end of the spout 14 which is sealed by the cap 16. Thus, when the base 24 is connected to the container 12, the passageway 22 of the spout 14 is in fluid communication with the opening 20 of the container 12.

Figure 3:
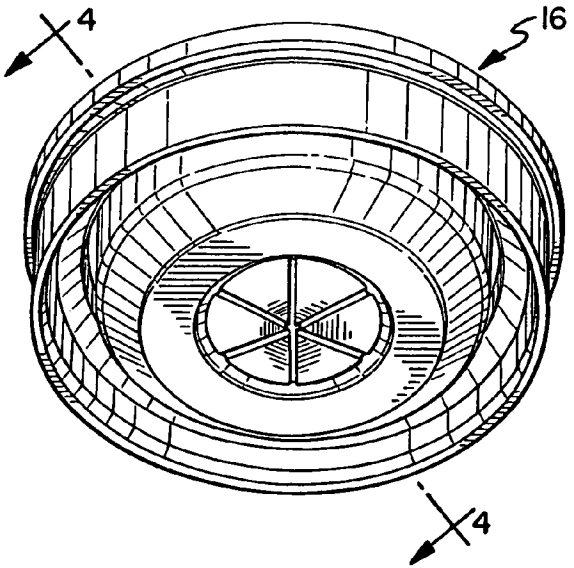
FIG. 3 is a bottom perspective view of a cap of the present invention.
Figure 4:
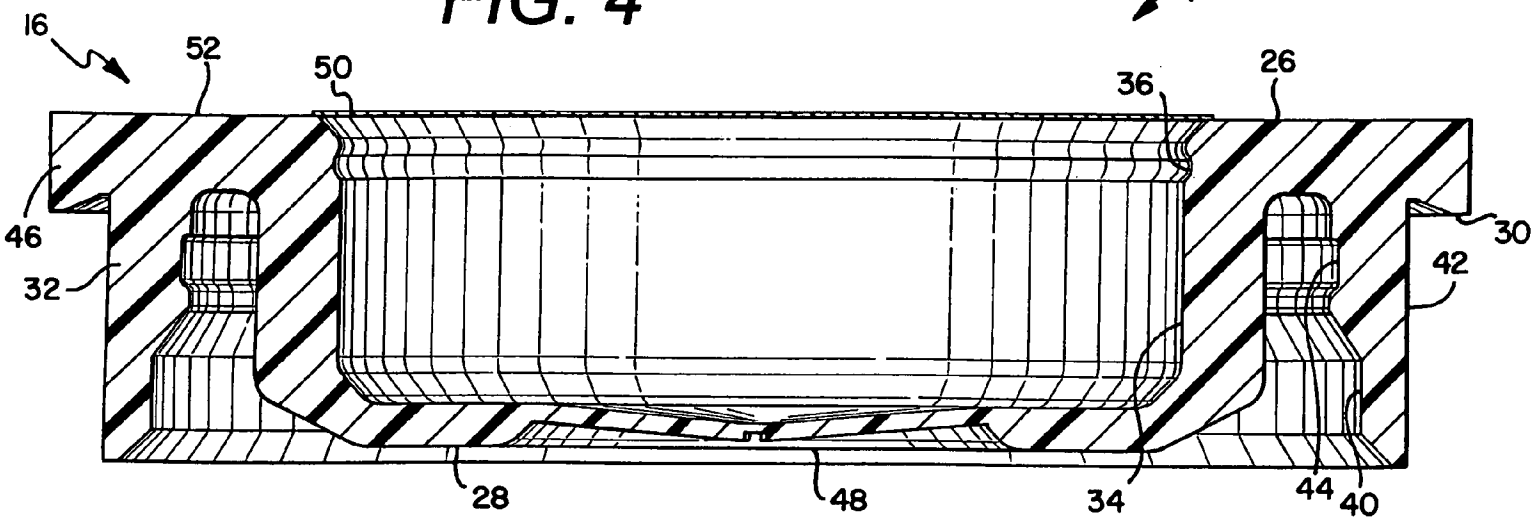
FIG. 4 is a cross-sectional view of the cap of the present invention.

FIGS. 3 and 4 illustrate the cap 16 of the present invention. The cap 16 may be formed integral with the spout 14, but more preferably, is a separate piece attached to an end of the spout 14 by any suitable means. The cap 16 is situated at an end of the spout 14 so the cap 16 seals that end of the spout 14. The cap 16 may be made of any suitable material, including rigid polymeric materials polypropylenes, polyethylenes, polyamides, polycarbonates, polyesters, polyester ethers, polyester elastomers, polystyrenes, acrylonitrile butadiene styrene block copolymers (ABS), or polyethylene terphthalate. Preferred materials for the cap 16 include high density polyethylene, low density polyethylene, and polypropylene.

The cap 16 includes a concentric platform 26 disposed about a concentric depression 28. The concentric platform 26 has a circumference 30. An annular ring .32 extends downwardly from the concentric platform 26. A circumferential wall 34 is formed inside the annular ring 32. The circumferential wall 34 also extends downwardly from the concentric platform 26 to the concentric depression 28. In this embodiment of the present invention, the circumferential wall 34 of the cap 16 includes at least one indent 36. The indent 36 is related to a sealing bead 38 on the piercer 18 as will be described below. The annular ring 32 includes an inner surface 40 and an outer surface 42. The inner surface 40 has a locking portion 44 for mating with the spout 12. The concentric platform 26 has a lip 46 extending perpendicularly outward from the annular ring 32. The cap 16 further includes a pierceable center 48. The pierceable center 48 may include indenting in its surface to facilitate piercing.

In a preferred embodiment, the cap 16 may be made in a two-part injection process where the pierceable center 48 is of a material that is more easily pierced than the remainder of the cap 16. In a further preferred embodiment, the pierceable center 48 may also be made of a material that is pliable such that it may provide sealing between the piercer 18 and cap 16 during communication of fluid through the piercer 18 after it has pierced the pierceable center 48. In this preferred embodiment, the pierceable center 48 is made of a thermoplastic elastomer (TPE). The remainder of the cap 16 may be made of materials such as HDPE or LDPE, or any suitable more rigid material. The more rigid material in the remainder of the cap 16 permits positive engagement to the spout 14, and increases the ability of the remainder of the cap 16 to withstand the high temperature environment of steam sterilization.

The cap 16 may also include a barrier 50 located on an exterior surface 52 of the cap 16. The barrier 50 covers at least a portion of an exterior surface 52 of the cap 16 to protect the pierceable center 48 and cap 16 from contaminants during shipment and handling of the container 12. Preferably, the barrier 50 covers at least all of the pierceable center 48. The barrier 50 made be made of any suitable material, including polymeric materials such as polyamides, polyester, or polyvinylidene chloride containing films. In a preferred embodiment, the barrier 50 may be substantially gas or oxygen impermeable, and the barrier 50 may include a material selected to provide a gas or oxygen barrier superior to the cap 16 material or the pierceable center 48. This will enhance the shelf life of the product stored in the container 12. The gas or oxygen barrier material can include foil, ethylene vinyl alcohol, polyvinyl alcohol, polyethylene, or a metalized polyester laminate depending on required heat resistance characteristics, but can be any suitable material. In a preferred embodiment, the barrier 50 is adhered to the exterior surface 52 of the cap 16 by heat sealing, but can be attached by ultrasonic welding or other known methods. The barrier 50 material is preferably coated with the same material of which the cap 16 is made to enhance sealing characteristics.

The material of the barrier 50 is also preferably selected to withstand heat from steam sterilization, and serves to protect the pierceable center 48 from heat during steam sterilization, acting as a heat shield or deflector to protect the pierceable center 48 from the steam heat. The barrier 50 also preferably provides a sterile zone around the pierceable center 48 to reduce possible contaminants to the contents of the container 12 during piercing of the pierceable center 48 by the piercer 18.

Figure 5:
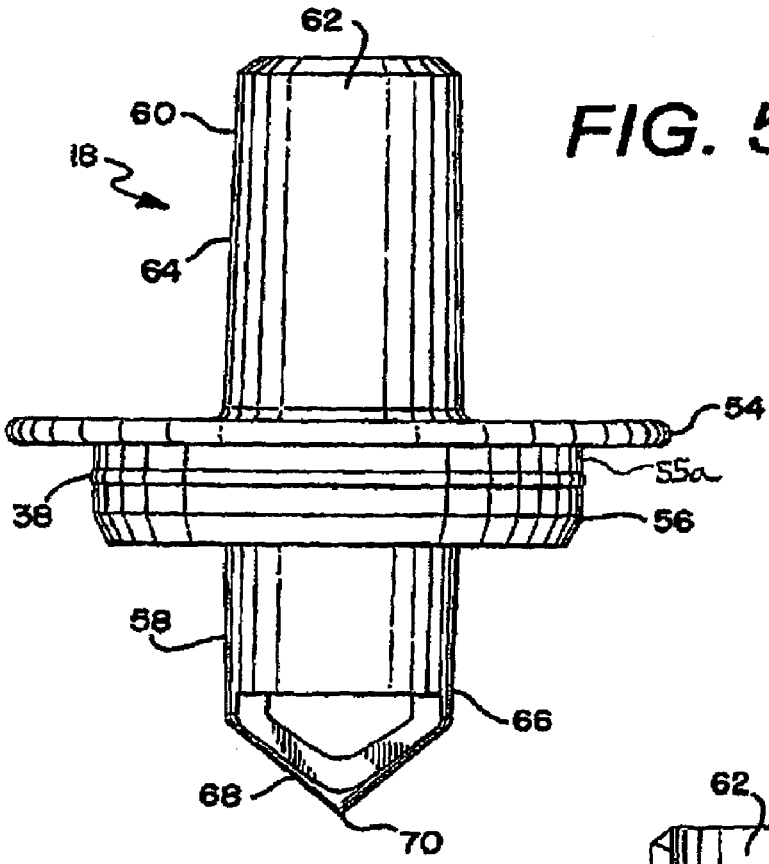
FIG. 5 is a side view of a piercer of the present invention.
Figure 6:
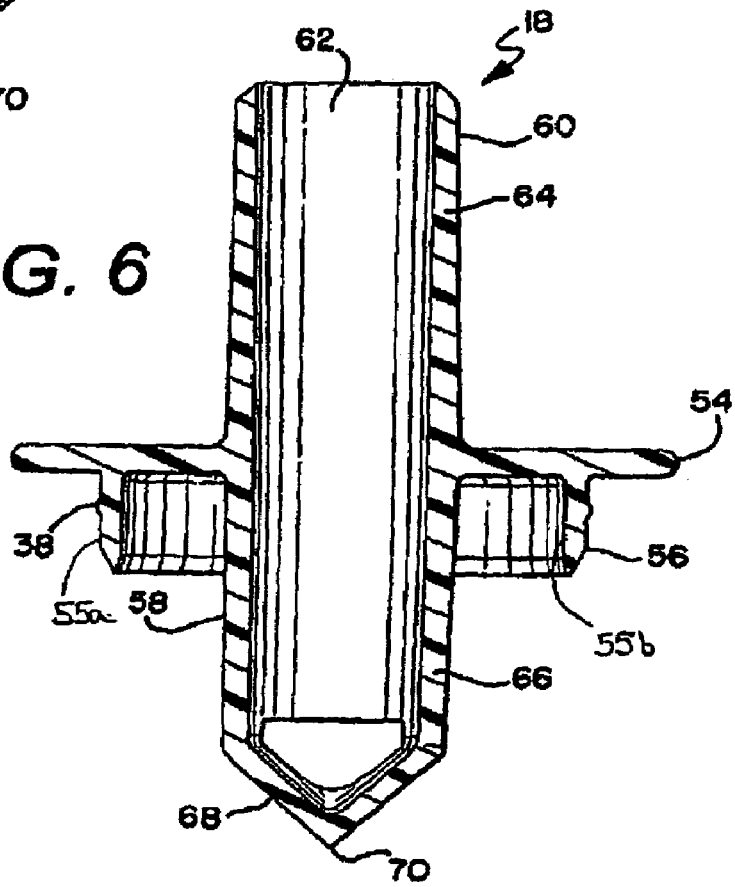
FIG. 6 is a cross-sectional view of a piercer of the present invention.

As shown in FIGS. 2, 5, and 6, the piercer 18 includes a flange 54 which extends perpendicularly outwardly from the piercer 18. The piercer 18 also has an annular skirt 56 extending downwardly from the flange 54 and having an outer surface and an inner surface 55*a, b*. The annular skirt 56 has at least one sealing bead 38. The sealing bead 38 is a protrusion which extends continuously around the annular skirt 56 of the piercer 18. In this embodiment of the present invention, the sealing bead 38 is related to the indent 36 on the circumferential wall 34 of the cap 16. Thus, when the piercer 18 punctures the cap 16 at the pierceable center 48, the sealing bead 38 forms a seal. The seal prevents fluid from leaking when the container 12 is being used.

It should be understood that the circumferential wall 34 of the cap 16 can include the sealing bead 38, and the annular skirt 56 of the piercer 18 can include the indent 36.

It should also be understood that the sealing bead 38 does not need a corresponding indent 36 to form a seal. A seal may be formed by pressing the sealing bead 38 to either the annular skirt 56 of the piercer 18 or the circumferential wall 34 of the cap 16.

In another embodiment, when the piercer 18 punctures the cap 16, the annular skirt 56 and the circumferential wall 34 are secured together. The annular skirt 56 uses at least one sealing bead 38 mating with at least one corresponding indent 36 on the circumferential wall 34 to provide an additional means of securing the piercer 18 to the cap 16.

It should be understood that the circumferential wall 34 may include the sealing bead 38, and the annular skirt 56 may include the indent 36. Additionally, the securing of the annular skirt 56 and the circumferential wall 34 may also serve as a seal.

The piercer 18 further includes a piercing end 58 and a nozzle end 60. The flange 54 has an opening 62 extending through its center. At the nozzle end 60, and disposed about and communicating with the opening 62 is a nozzle 64. The nozzle 64 extends perpendicularly from the flange 54.

Disposed and encompassed by the annular skirt 56 is a piercing piece 66. The piercing piece 66 extends perpendicularly from the flange 54 and is preferably cylindrical, but may be any suitable shape, and is disposed about and in communication with the opening 62 in the flange 54. At a distal end 68 of the piercing piece 66 are sharpened portions 70. The distal end 68 may be angled to enhance piercing. The purpose of the sharpened portions 70 will become apparent in the description to follow. The piercer 18 may be made of any suitable material, including those described above for the spout 14 and cap 16. It is desirable that the piercer 18, and in particular the piercing piece 66 be made of a material sufficiently rigid as compared to the cap 16 to permit the piercer 18 to pierce the cap 16. A preferred material for the piercer 18 is polypropylene.

The method of the present invention proceeds as follows. The spout 14 is attached to the container 12. The container 12 is filled with the desired contents through the spout 14. After filling, the cap 16 with the barrier 50 already attached is placed and pressed onto the spout 14. At this or any suitable point, the cap 16 and barrier 50 may be steamed to decontaminate them.

When a user desires to access the contents of the container 12, the user removes the barrier 50. The user then inserts the piercer 18 onto the pierceable center 48 of the cap 16. The user applies pressure to the flange 54, and the sharpened portions 70 of the piercing piece 66 pierce the pierceable center 48. This permits fluid communication between the contents of the container 12 through the piercing piece 66 and nozzle 64. The contents of the container 12 can be directed using a tube (not shown) attached to the nozzle 64.

The piercer 18 is held to the cap 16 by the piercing piece 66 of the piercer 18 and the pierceable center 48 of the cap 16 and the sealing bead 38 of the annular skirt 56 and the indent 36 on the circumferential wall 34. In this embodiment, a seal is also formed between the annular skirt 56 and the circumferential wall 34 by the sealing bead 38 and the indent 36.

While the specific embodiments have been illustrated and described, numerous modifications come to mind without significantly departing from the spirit of the invention and the scope of protection is only limited by the scope of the accompanying Claims.

The invention claimed is:

1. A fitment assembly for a container comprising:

a spout connected to the container and in fluid communication therewith and having a wall;

a cap having a concentric platform having an outer peripheral surface and a first planar surface, a first annular wall extends axially away from the first planar surface and is spaced radially inwardly from the outer peripheral surface, a second annular wall extends axially away from the first planar surface and is spaced radially inwardly and is coaxially disposed with respect to the first annular wall to define an annular space therebetween, a portion of the spout wall is disposed within the annular space to attach the cap to the spout, the second annular wall having a first outer surface in contact with a portion of the spout wall and a first inner surface defining a circumferential depression radially inwardly therefrom; and a piercer having a tubular body with opposed first and second ends and a fluid pathway therethrough, the tubular body having a piercing member at the first end and a fluid outlet at the second end, a circumferential flange extends radially outwardly from the tubular body from an intermediate portion thereof and having a second inner surface and a second outer surface, an annular skirt extends axially downwardly from the second inner surface of the circumferential flange and has a third outer surface in surface contact with the first inner surface of the second annular wall to form an interference fit therewith to connect the piercer to the cap.

2. The assembly of claim 1 wherein the first end of the piercer extends axia1ly beyond an axial end of the first annular wall and the second annular wall.

3. The assembly of claim 1 wherein the second end of the piercer extends axially beyond the concentric platform and the circumferential flange.

4. The assembly of claim 1 further comprising a sealing member on the cap for sealing to the piercer.

5. The assembly of claim 1 further comprising a bottom wall extending from a distal end of the second annular wall to seal the circumferential depression, the bottom wall having a centrally disposed pierceable center that is pierced by the piercing member.

6. The assembly of claim 5 wherein the pierceable center has indentations in a surface to facilitate ease of piercing.

7. The assembly of claim 5 wherein the pierceable center is of a first material that is different from a second material of the cap.

8. The assembly of claim 7 wherein the cap is made in a two-part injection molding process.

9. The assembly of claim 7 wherein the cap is made from an HDPE or an LDPE and the piercing center is made from a thermoplastic elastomer.

10. The assembly of claim 1 wherein a portion either the cap or the piercer has an annular bead and the other of the cap or the piercer has an indent that receives the bead to lock the parts together.

* * * * *